US007310832B2

(12) United States Patent
Spadola

(10) Patent No.: US 7,310,832 B2
(45) Date of Patent: Dec. 25, 2007

(54) APPARATUS FOR OPERATING TOILET FLUSH VALVES

(76) Inventor: Joseph Spadola, 334 Shaler Blvd., Ridgefield, NJ (US) 07657

( * ) Notice: Subject to any disclaimer, the term of this patent is extended or adjusted under 35 U.S.C. 154(b) by 211 days.

(21) Appl. No.: 11/265,616

(22) Filed: Nov. 2, 2005

(65) Prior Publication Data

US 2007/0094780 A1 May 3, 2007

(51) Int. Cl.
*E03D 5/00* (2006.01)

(52) U.S. Cl. ..... 4/405

(58) Field of Classification Search ..... 4/405, 4/406, 408, 410, 411, 412, 414
See application file for complete search history.

(56) References Cited

U.S. PATENT DOCUMENTS

| | | | | |
|---|---|---|---|---|
| 1,553,692 | A | 9/1925 | Huckle | |
| 1,729,546 | A | 9/1929 | Myers | |
| 2,046,888 | A * | 7/1936 | Watt | 4/412 |
| 2,412,738 | A * | 12/1946 | Martin | 4/412 |
| 3,302,217 | A * | 2/1967 | Schrock | 4/386 |
| 3,912,261 | A | 10/1975 | Lambert | |
| 4,048,896 | A | 9/1977 | Calato | |
| 4,256,302 | A | 3/1981 | Keiser | |
| 4,268,084 | A | 5/1981 | Peters | |
| 4,903,677 | A | 2/1990 | Colley | |
| 5,031,599 | A | 7/1991 | Cruise | |
| 5,054,744 | A | 10/1991 | Essex | |
| 6,073,903 | A | 6/2000 | Lindsay | |
| 6,112,732 | A | 9/2000 | Larson | |
| 2002/0029412 | A1 | 3/2002 | Veal | |

FOREIGN PATENT DOCUMENTS

| | | |
|---|---|---|
| DE | 4138725 A1 | 5/1993 |
| WO | WO 96/30693 | 10/1996 |

* cited by examiner

*Primary Examiner*—Huyen Le
(74) *Attorney, Agent, or Firm*—Michael A. Blake

(57) ABSTRACT

An automatic flush valve comprising: a linear actuator; an actuator rod in operable communication with the linear actuator; an actuator chain in communication with the actuator rod; a wheel anchor in communication with the actuator chain; a force compensating wheel in communication with the wheel anchor; a flush valve chain in communication with the wheel anchor; a actuated valve component in communication with the flush valve chain; a flush valve in operable communication with the actuated valve component; and where the force compensating wheel is configured to rotate about an off center axle. The disclosed apparatus also relates to an automatic toilet flush valve comprising: a linear actuator; an actuator rod in operable communication with the linear actuator; an actuator chain in communication with the actuator rod; a compound force compensating wheel in communication the actuator chain, the compound force compensating wheel comprising: a first wheel; a first wheel anchor in communication with the first wheel; a second wheel in fixed communication with the first wheel; a second wheel anchor in communication with the second wheel; a flush valve chain in communication with the compound force compensating wheel; a actuated valve component in communication with the flush valve chain; a flush valve in operable communication with the actuated valve component; and where the compound force compensating wheel is configured to rotate about an off center axle.

13 Claims, 10 Drawing Sheets

14

8
102
12
8
Chain Shock
Absorber
Front View
106
110
70
14
22
18
Chain Shock
Absorber
Side View
106
110
70
102
74
78

APPARATUS FOR OPERATING TOILET FLUSH VALVES

TECHNICAL FIELD

This invention relates generally to automatic flushing systems for toilets. More particularly, this invention relates to automatic flushing systems for toilets which include a variable force linear actuator in communication with a flush valve.

BACKGROUND

It is generally desirable to be able to use a toilet without touching the toilet or at least touching the toilet as little as possible. For health reasons, both real and imagined, it is especially desirable to minimize or eliminate touching of a toilet or any of its components by hand. Hands come into contact with not only food and eating utensils, but with other people. It is well known that toilets harbor microorganisms for numerous diseases from dysentery to hepatitis. Moreover, it is well known that many people are not in the habit of washing their hands after using a toilet. Consequently, avoidance of touching the surfaces of toilets can help break disease transmission chains. While having touch free toilets in homes is certainly desirable for many reasons, public touch free toilets are highly desirable because the users do not know one another and are not in constant contact and proximately with one another, other than through common toilet use.

It is of course, highly desirable to have automatic flush which are usable with newly manufactured toilets and with the millions of toilets, both public and private, which already exist. Practically all toilets which use a flush tank have overflow tubes and flush valves which close flush tank outlets that dump water at a rapid rate from the flush tanks into toilet bowls. In view of these considerations, there is a need for automatic flushing which is readily adaptable to both original equipment and existing installations.

Automatic flushing systems often use a linear mechanical actuator to provide the mechanical force to open a flush valve. Although the direction of the produced force from a linear mechanical actuator is generally linear, the amount of force, over the mechanical actuator's dynamic range, may not be linear. A force must be applied to mechanical loads such as those required for flush valve lifting. Additionally, while the direction of the required force is generally linear, the amount of force required, over its dynamic range, may not be linear.

It is often found that the length of the throw and the non-linear dynamic force characteristics of a linear mechanical actuator cannot be efficiently matched to a required linear mechanical load, such as a flush valve in a toilet. Thus there is a need for a simple and easily adaptable device that can properly match the force provided by a linear actuator to a variable mechanical load, such as raising a flush valve.

SUMMARY

The disclosed apparatus relates to an automatic flush valve comprising: a linear actuator; an actuator rod in operable communication with the linear actuator; an actuator chain in communication with the actuator rod; a wheel anchor in communication with the actuator chain; a force compensating wheel in communication with the wheel anchor; a flush valve chain in communication with the wheel anchor; a actuated valve component in communication with the flush valve chain; a flush valve in operable communication with the actuated valve component; and where the force compensating wheel is configured to rotate about an off center axle.

The disclosed apparatus also relates to an automatic toilet flush valve comprising: a linear actuator; an actuator rod in operable communication with the linear actuator; an actuator chain in communication with the actuator rod; a compound force compensating wheel in communication the actuator chain, the compound force compensating wheel comprising: a first wheel; a first wheel anchor in communication with the first wheel; a second wheel in fixed communication with the first wheel; a second wheel anchor in communication with the second wheel; a flush valve chain in communication with the compound force compensating wheel; a actuated valve component in communication with the flush valve chain; a flush valve in operable communication with the actuated valve component; and where the compound force compensating wheel is configured to rotate about an off center axle.

The disclosed apparatus, in addition, relates to an electromechanical toilet flush valve actuator for use in automatic toilet flushing systems comprising: a toilet tank; a water-barrier container located in the toilet tank; a linear actuator located in the water-barrier container; an actuator rod, located in the water-barrier container, in operable communication with the linear actuator; a shock absorber mechanism in operable communication with the actuator rod; an actuator chain in operable communication with the shock absorber mechanism; a flush valve actuator frame attached to the water-barrier container such that a portion of the flush valve actuator frame is located inside the water-barrier container and a portion of the flush valve actuator frame is located outside of the water-barrier container; a first idler pulley located within the water-barrier container and rotatably coupled to the flush valve actuator frame; a second idler pulley located outside of the water-barrier container, and rotatably coupled to the flush valve actuator frame; a force compensating wheel located outside of the water-barrier container, and rotatably coupled to the flush valve actuator frame via an off center axle rotatably coupled to the flush valve actuator frame; a wheel anchor in communication with force compensating wheel; a flush valve located in the toilet tank; an actuated valve component in operable communication with the flush valve; a flush valve chain in communication with the actuated valve component; and where the wheel anchor is in communication with the actuator chain and with the flush valve chain.

BRIEF DESCRIPTION OF THE DRAWINGS

The present disclosure will be better understood by those skilled in the pertinent art by referencing the accompanying drawings, where like elements are numbered alike in the several figures, in which:

FIG. 2 is a schematic diagram of the disclosed apparatus for operating a flush valve with a force compensating wheel from FIG. 1, with the wheel rotated about 45°;

DETAILED DESCRIPTION

Figure 1:
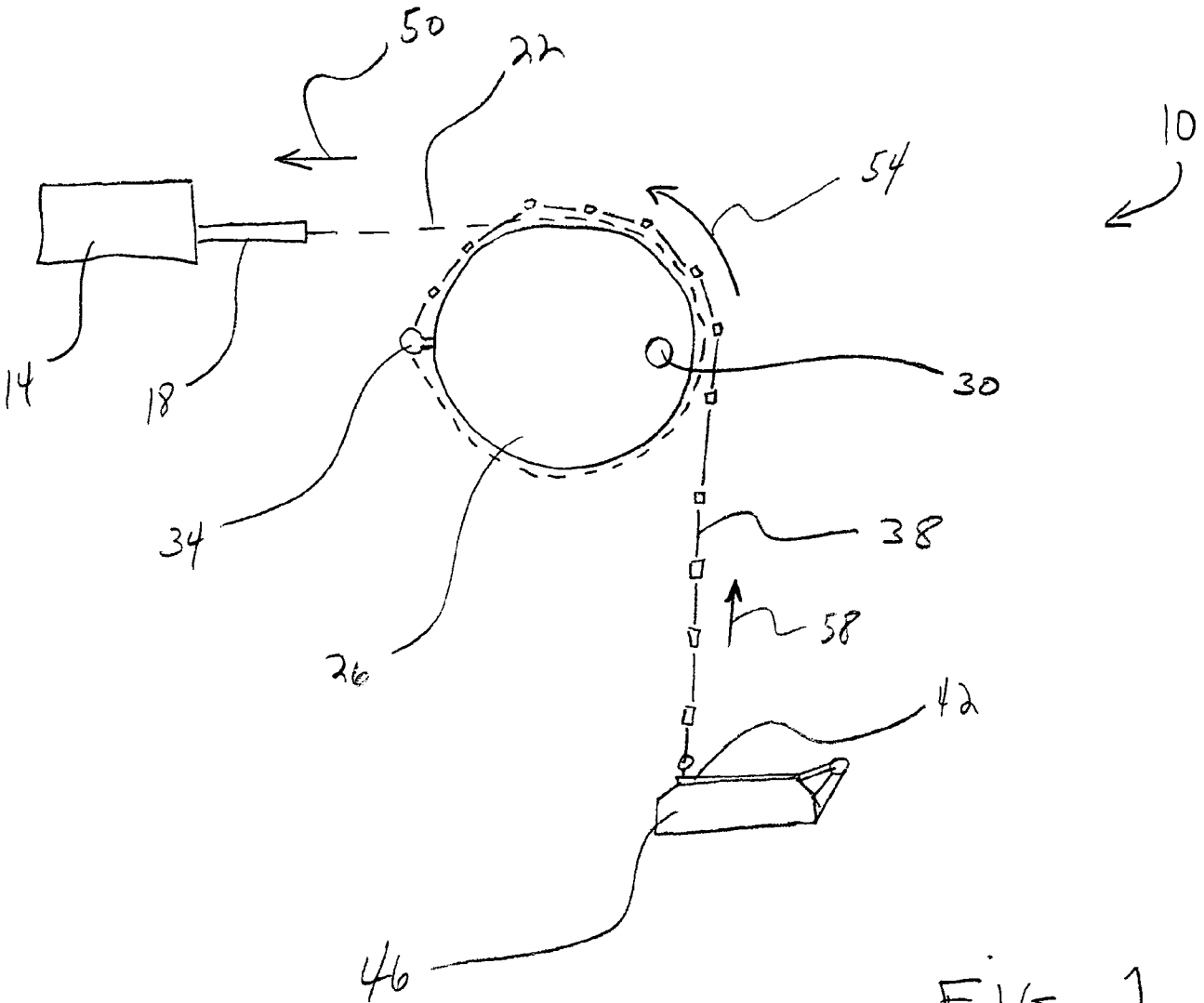
FIG. 1 is a schematic diagram of the disclosed apparatus for operating a flush valve with a force compensating wheel.

FIG. 1 is a schematic diagram showing one embodiment of the disclosed variable force linear actuator system 10. An actuator 14 is shown with an actuator rod 18. The actuator 14 is a linear actuator. Any suitable actuator that is small enough to fit into a toilet tank may be used, such actuators include but are not limited to: tubular solenoids such as the Magnet Schultz TYPE RT 24×19 DC PULL TYPE SOLENOID, Magnet-Schultz of America, 401 Plaza Drive, Westmont, Ill. 60559; tubular solenoids from Ledex & Dormeyer Products, 801 Scholz Drive, Vandalia, Ohio 45377; and tubular solenoids from BLP Components Ltd., 1501 Route 34, South Farmingdale, N.J. 07727. Attached to the actuator rod 18 is an actuator chain 22. The actuator chain 22 may be any flexible device such as, but not limited to: a belt, a chain, a beaded chain, a strap, and a cord. The actuator chain is wrapped around a force compensating wheel 26 with an off center axle 30. The force compensating wheel 26 is configured to rotate about the off center axle 30. The actuator chain 22 is coupled to the force compensating wheel 26 at wheel anchor 34. Also coupled to the wheel anchor 34 is a flush valve chain 38. The flush valve chain 38 rides around the force compensating wheel 26. The actuator chain 22 extends from the anchor 34 around the wheel 26 in a first direction. The flush valve chain 38 extends from the anchor 34 around the wheel 26 in a direction generally opposite that of the first direction. Attached to another end of the flush valve chain 38 is an actuated valve component 42 of a flush valve 46. If the flush valve 46 is a flapper valve, then the actuated valve component 42 would be the flapper. If the flush valve 46 is a Mansfield type flush valve, then the actuated valve component 42 would be the float. The flush valve chain 38 may be any flexible device such as, but not limited to: a belt, a chain, a beaded chain, a strap, and a cord. When the actuator 14 actuates, the rod 18 moves to the left as indicated by the arrow 50. The rod 18 pulls the actuator chain 22 to the left which causes the force compensating wheel 26 to rotate about the off center axle 30 in the direction shown by the arrow 54. As the force compensating wheel rotates counterclockwise, the flush valve chain 38 is rolled onto the force compensating wheel 26, thereby causing the flush valve chain 38 to move up in the direction of the arrow 58 and also begin to open the actuated valve component 42. Although a flush valve, and flapper, and flapper chain are discussed in this embodiment, it should be obvious to one of ordinary skill in the art that many types valves may be used, including but not limited to: Watersaver 210 and Ultra Low Flush 211 ULF flush valves by Mansfield Plumbing Products, Inc., 150 First Street, Perrysville, Ohio 44864; plastic flush valve with a thermoplastic flapper, and a brass flush valve with rubber flush ball.

In a preferred embodiment, the force compensating wheel should be set up to rotate about 180 degrees so the circumference, where the chain sits, should be about twice the pull length of the chain. In one working model the chain pull has a length of about 2⅛ inches and the wheel bed diameter is 1⅜ inches, thus the circumference is 1.375×3.14 =4.32 inches. Half of 4.32 inches is 2.16 inches which is fairly close to the chain pull of 2.125 inches. It should be noted that the force compensating wheel is not required to be round, but may be other shapes as well.

The axle position is what determines the ratio spread for a given force compensating wheel. The initial starting position determines the sequence of the ratio excursion. One can locate the axle position by experimentation. Another means for locating the axle on the force compensating wheel is to take accurate measurements of the dynamic force characteristics of the solenoid and factor in any other fixed mechanical advantage or disadvantage and plot that on a graph. Next, measure and plot a graph of the dynamic force requirements of the flush valve. At a number of points, determine what ratio would be needed for the solenoid to overcome the load. Now assuming the solenoid is capable of delivering enough force, throughout its range, a designer, skilled in the computations required could position the axle to achieve the best and smoothest working compromise. There is a factor that complicates this computation. While it is relatively easy to calculate the mechanical advantage of the axle to tangent force arms, at any given wheel position, it is less obvious how to calculate the effect of the wheel as it rises and lowers and thus further affecting the chain pull and resulting ratios. Another factor that affects the load curve is how fast the water evacuates the tank in concert with the position of the actuated valve component. The sequence of the loads exerted on the flush valve is generally as follows: first the actuator must overcome the weight of the column of water sitting on a certain area flush valve, second the actuator must overcome the effect of the water, rushing past the actuated valve component, which is acting like a sail, on its way down the tube. Eventually the actuated valve component is lifted high enough so the rushing water has much less effect.

FIG. 2 shows the disclosed variable force linear actuator system 10 of FIG. 1, where the force compensating wheel 26 has rotated about 45° in a counterclockwise direction, the direction indicated by the arrow 54. The actuated valve component 42 has been raised from the flush valve 46 due to the flush valve chain 38 moving in the direction of the arrow 58. The actuator rod 18 continues moving to the left in the direction of the arrow 50.

Figure 3:
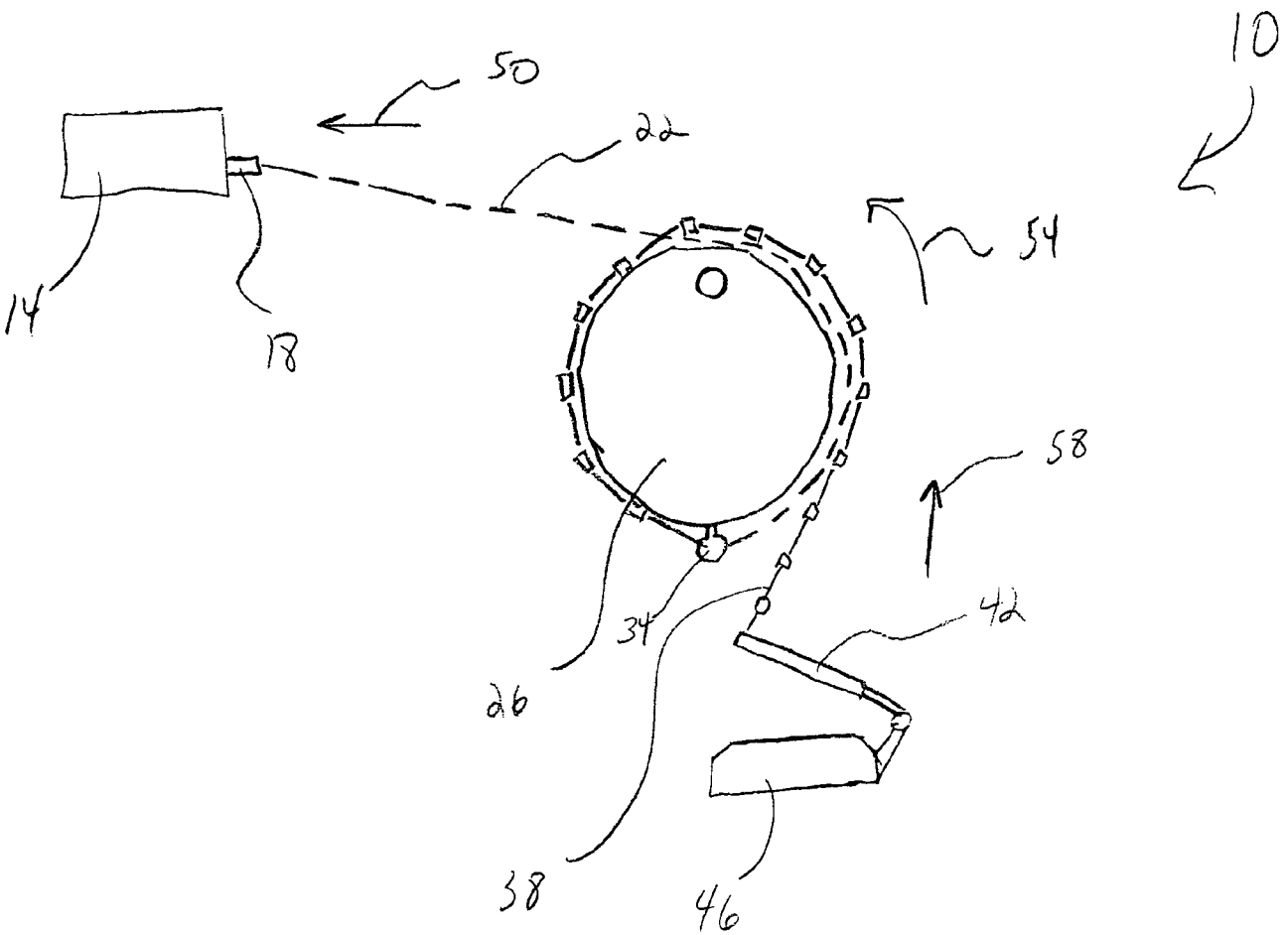
FIG. 3 is a schematic diagram of the disclosed apparatus for operating a flush valve with a force compensating wheel from FIG. 1, with the wheel rotated about 90°.

FIG. 3, shows the disclosed variable force linear actuator system 10 of FIG. 1, where the force compensating wheel 26 has rotated about 90° in a counterclockwise direction, the direction indicated by the arrow 54. The actuated valve component 42 has been raised higher than that shown in FIG. 2, due to the flush valve chain 38 moving generally in the direction of the arrow 58. The actuator rod 18 continues moving to the left in the direction of the arrow 50.

Figure 4:
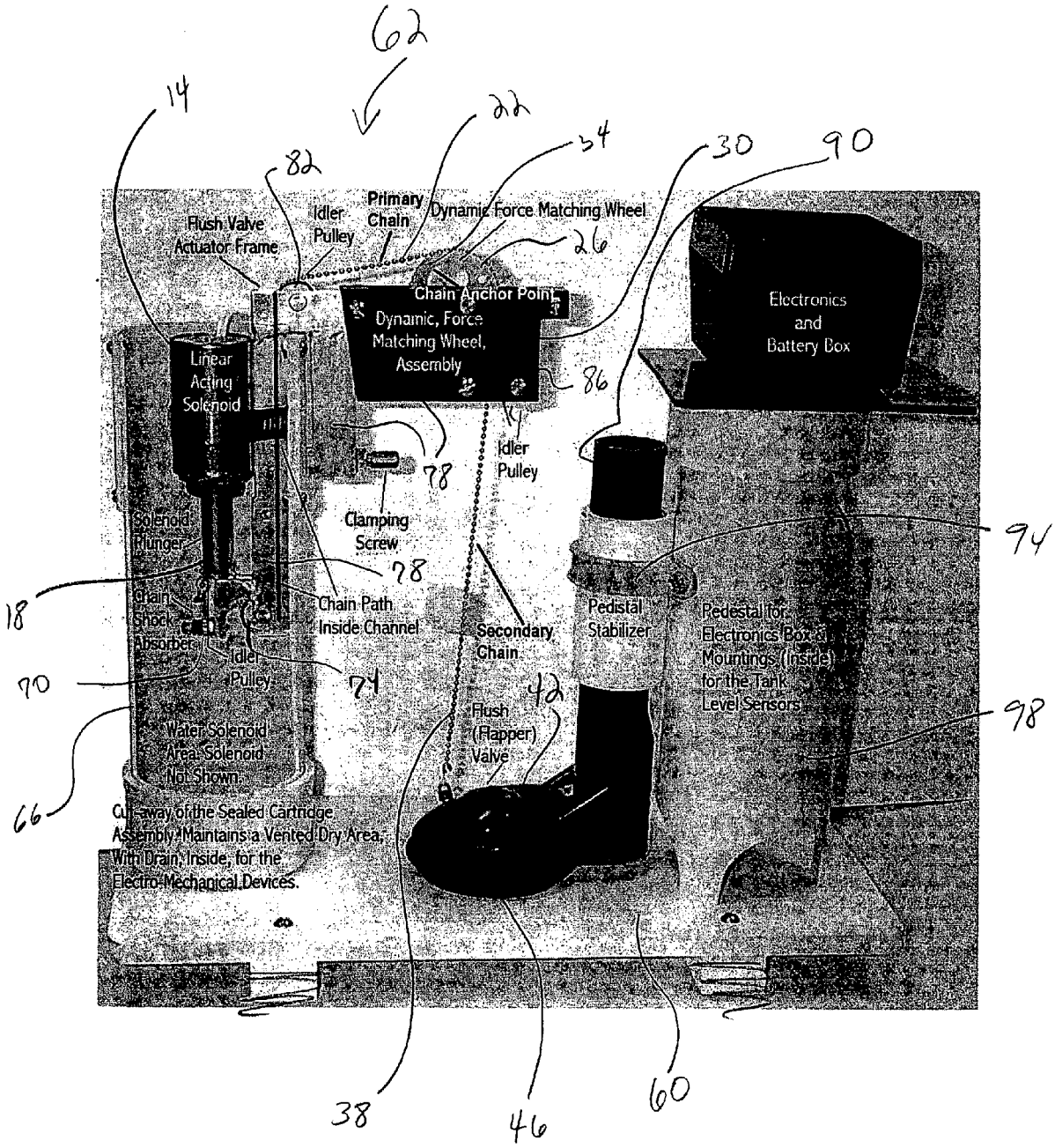
FIG. 4 is a schematic diagram of an automatic flush toilet apparatus comprising a force compensating wheel.

FIG. 4 shows a more detailed schematic of another embodiment of the disclosed variable force linear actuator system 62 in an automatic flush toilet apparatus. The tank floor 60 of a toilet is shown, with the tank walls and tank lid removed for easier viewing. The actuator 14 and actuator rod 18 are located inside a water-barrier container 66 (shown partially open). The container may be generally cylindrical shaped or any other suitable shape to fit within the toilet tank. Additionally, the water-barrier container 66 may have an open top. The actuator chain 22, is in this embodiment a beaded chain, and is coupled to the rod 18 via a chain shock absorber mechanism 70, which will be shown in more detail in FIG. 5. The actuator chain 22 goes around an idler pulley 74 through a flush valve actuator frame 78 and around another idler pulley 82 to the force compensating wheel 26. The axle 30 of the force compensating wheel 26 is supported by flush valve actuator frame 78. A flush valve chain 38 is connected to the force compensating wheel 26 and rides about an idler pulley 86 and to the actuated valve component 42. The purpose of the idler pulley 86 is twofold. First it gives the chain a straighter pull, as the wheel rotates away from the actuator frame. Second it has the effect of increasing the final lift by creating a longer chain path. In this embodiment, the flush valve 46 is located at the base of an inflow pipe 90. Attached to the inflow pipe 90, via a stabilizer attachment means 94 is a pedestal 98. The pedestal may support mounting means for various components such as, but not limited to: electronic controls, wiring, battery and various sensors such as tank water level sensors.

Figure 6:
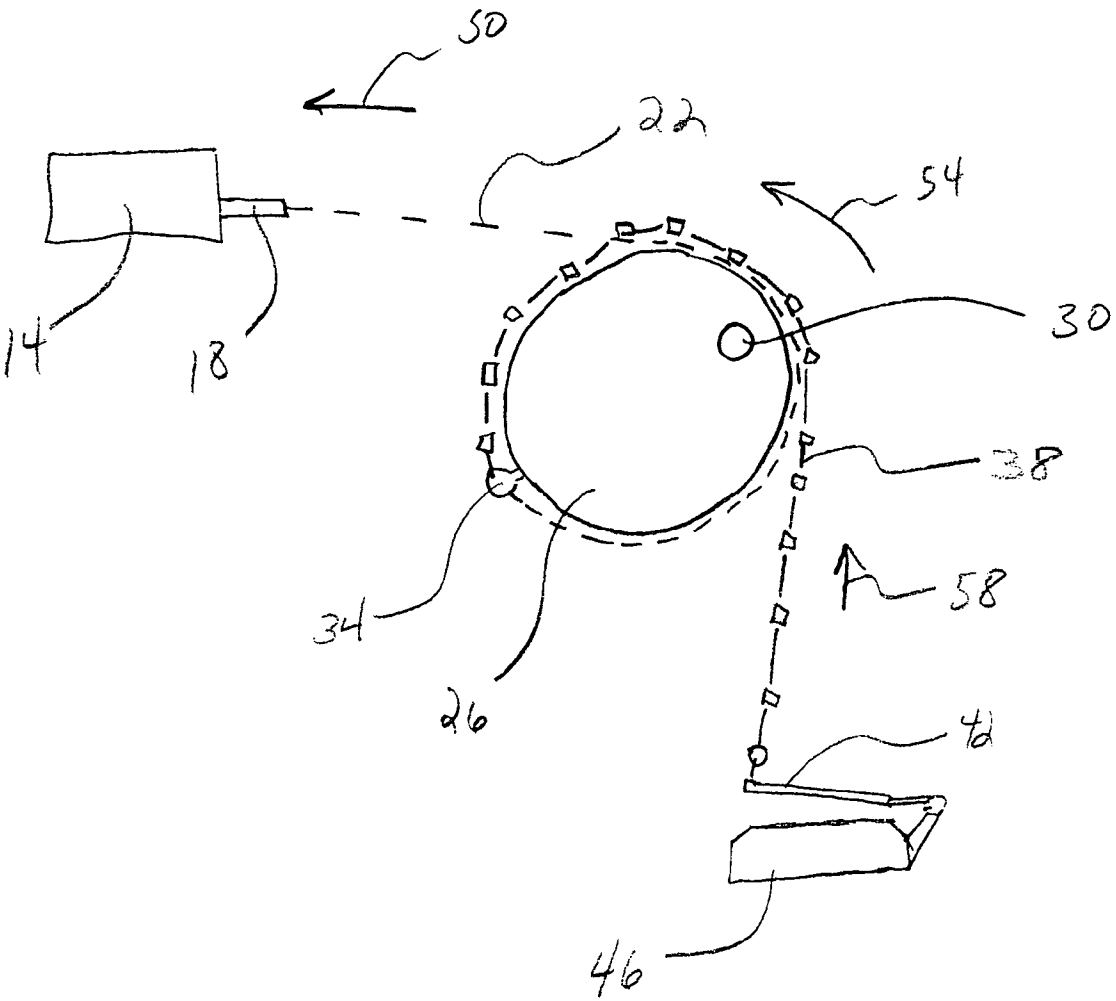
FIG. 6 is a side view of the shock absorbing apparatus from FIG. 5.
Figures 5, 6:
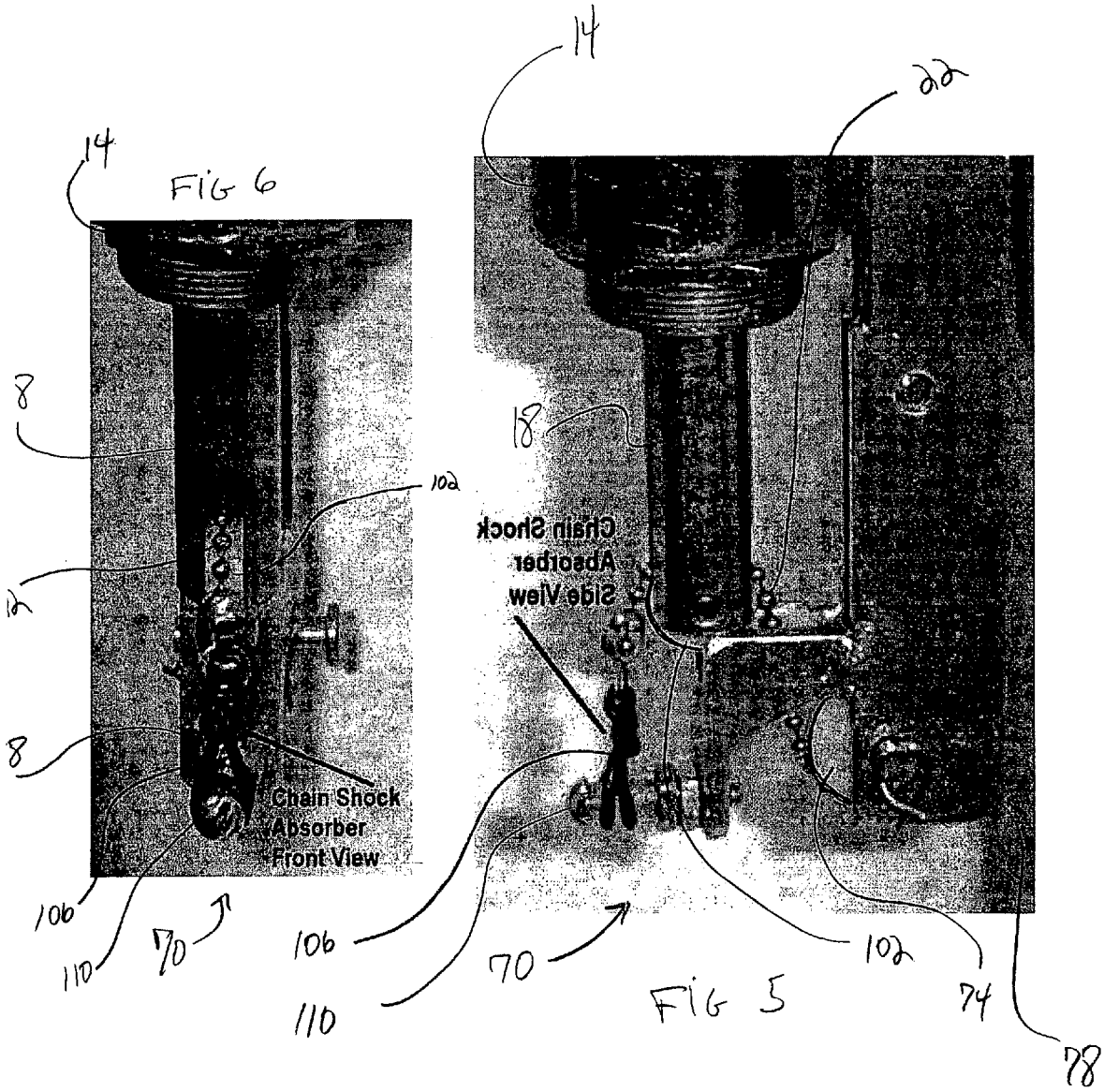
FIG. 5 is a front view of a shock absorbing apparatus.

FIG. 5 is a detailed front view of the chain shock absorber mechanism 70. The rod 18 is coupled to a pulley 102. The actuator chain 22 rides on the pulley 102. The chain 22 is coupled to a flexible shock absorber 106. The flexible shock absorber 106 is coupled to a shock absorber anchor 110. The actuator chain 22 also rides on the idler pulley 74 as shown in FIG. 4. The compact elastic shock absorber 106 has been designed to take up any hard acceleration shock. While the shock absorber 106 provides only a small amount of movement it can absorb a relatively large amount of shock thereby prolonging the life of the actuator chain 22. The shock absorber 106 may be selected from the following: Neoprene, Ethylene Propylene Diene Monomer.

FIG. 6 shows a side view of the chain shock absorber mechanism 70 from FIG. 5.

Figure 7:
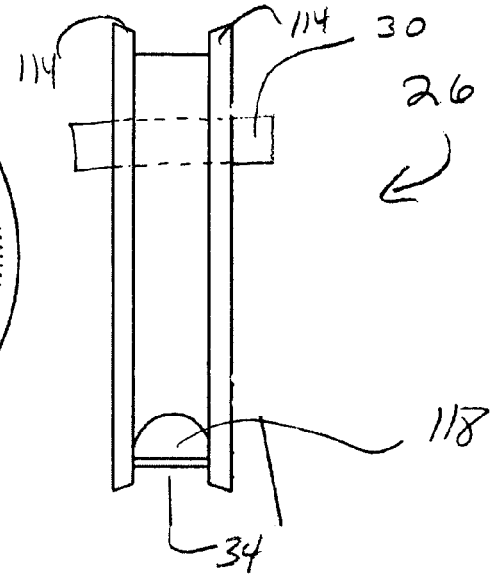
FIG. 7 is a side view of a force compensating wheel.

FIG. 7 shows a side view of one embodiment of a force compensating wheel 26. The off center axle 30 is shown near the top of the force compensating wheel 26. An anchor 34 is located near the bottom of the force compensating wheel 26. The force compensating wheel 26 may have raised sides 114 in order to keep the chains 22, 38 properly positioned on the force compensating wheel 26. The raised sides 114 form a channel that holds the chains 22, 38 on the wheel 26. The force compensating wheel 26 may have a recess 118 located near the anchor 34, to allow room for a variety of anchoring hardware to couple the chains 22,38 to the anchor 34.

Figure 8:
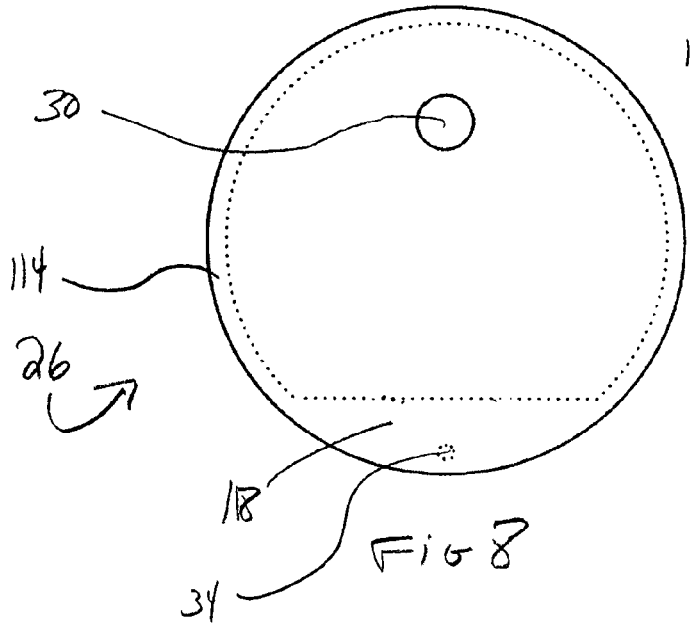
FIG. 8 is a front view of the force compensating wheel from FIG. 7.

FIG. 8 shows a front view of the force compensating wheel 26 from FIG. 7.

Figure 10:
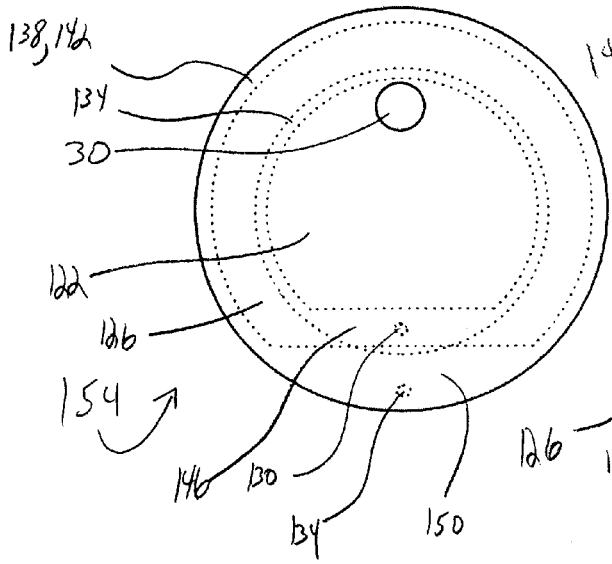
FIG. 10 is a front view of the compound force compensating wheel from FIG. 9.
Figure 9:
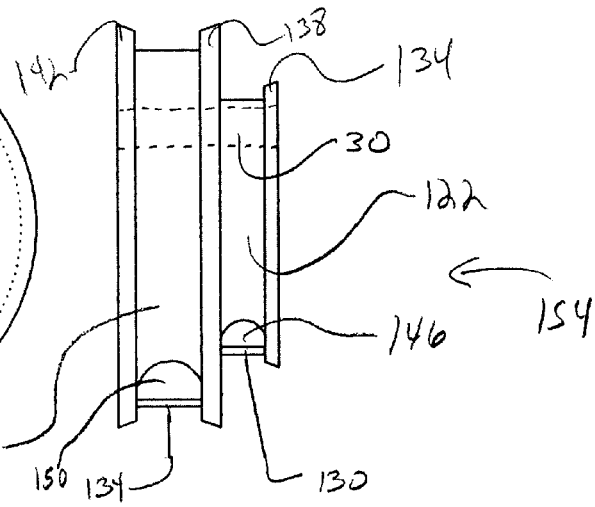
FIG. 9 is a side view of a compound force compensating wheel.

FIG. 9 shows a side view of another embodiment of a force compensating wheel 154. In this embodiment the force compensating wheel 154 is a compound wheel comprising a first wheel 122 fixably coupled to a second wheel 126. The wheels share the same off center axle 30. Each wheel has its own anchor 130, 134. The first wheel 122 has a raised side 134, and the second wheel 126 has two raised sides 138, 142. The raised sides 134, 138, 142 form two channels, one on each wheel 122, 126 to keep the chains 22, 38 on the respective wheels. In this embodiment, one of the chains 22, 38 will couple to the anchor 130 and ride on the first wheel 122, and the other chain will couple to the anchor 134 and ride on the second wheel 126. Wheel 122 has a recess 146, and wheel 126 has a recess 150. The recesses 146, 150 allow room for a variety of anchoring hardware to couple the chains 22, 38 to the anchors 130, 134 respectively. FIG. 10 shows a front view of the force compensating wheel 154. The use of compound wheels allows the designer of an automatic flushing toilet to further vary the mechanical advantage of the wheel.

Figure 11:
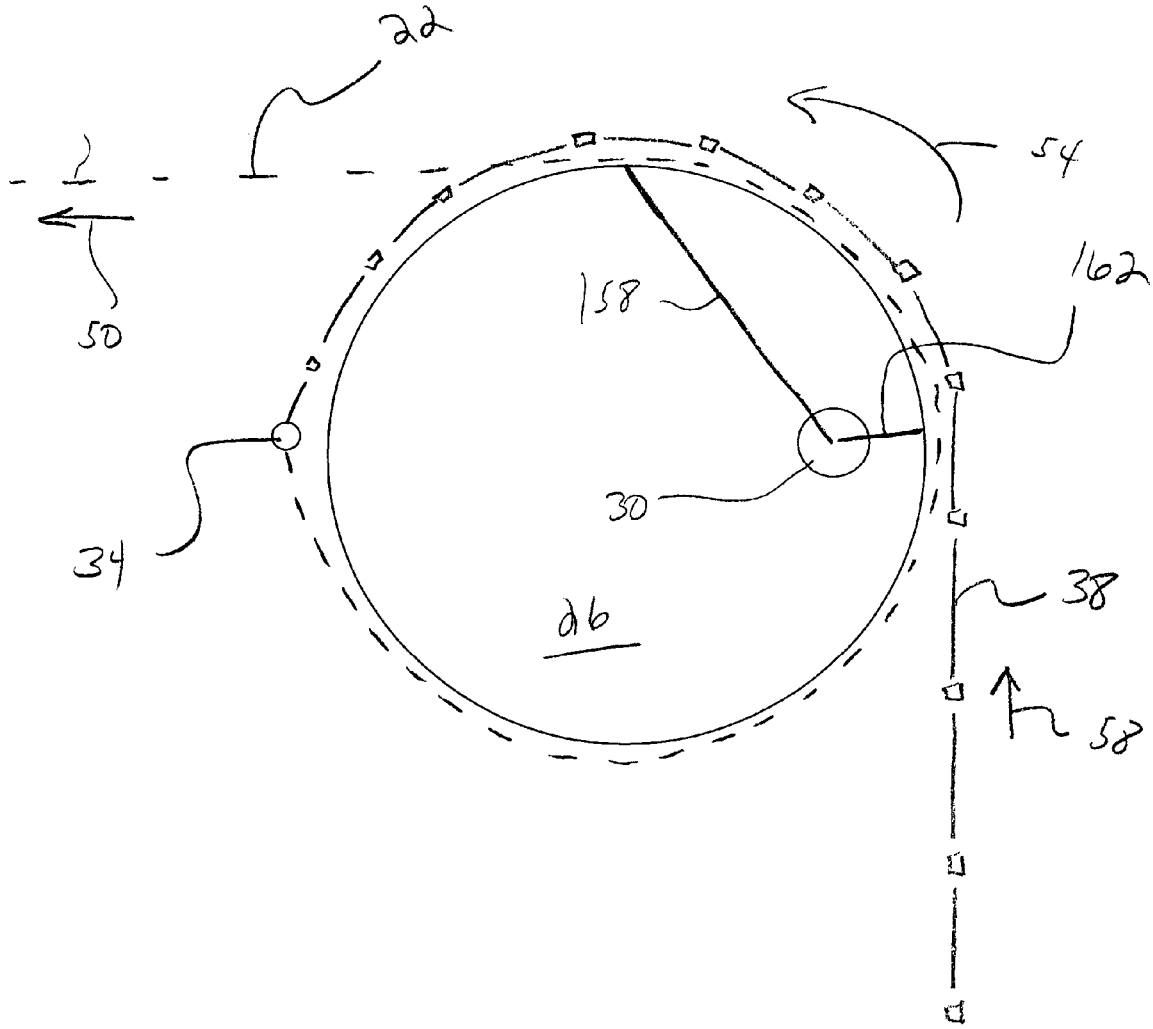
FIG. 11 is a schematic diagram illustrating the mechanical advantage delivered by the force compensating wheel.
Figure 12:
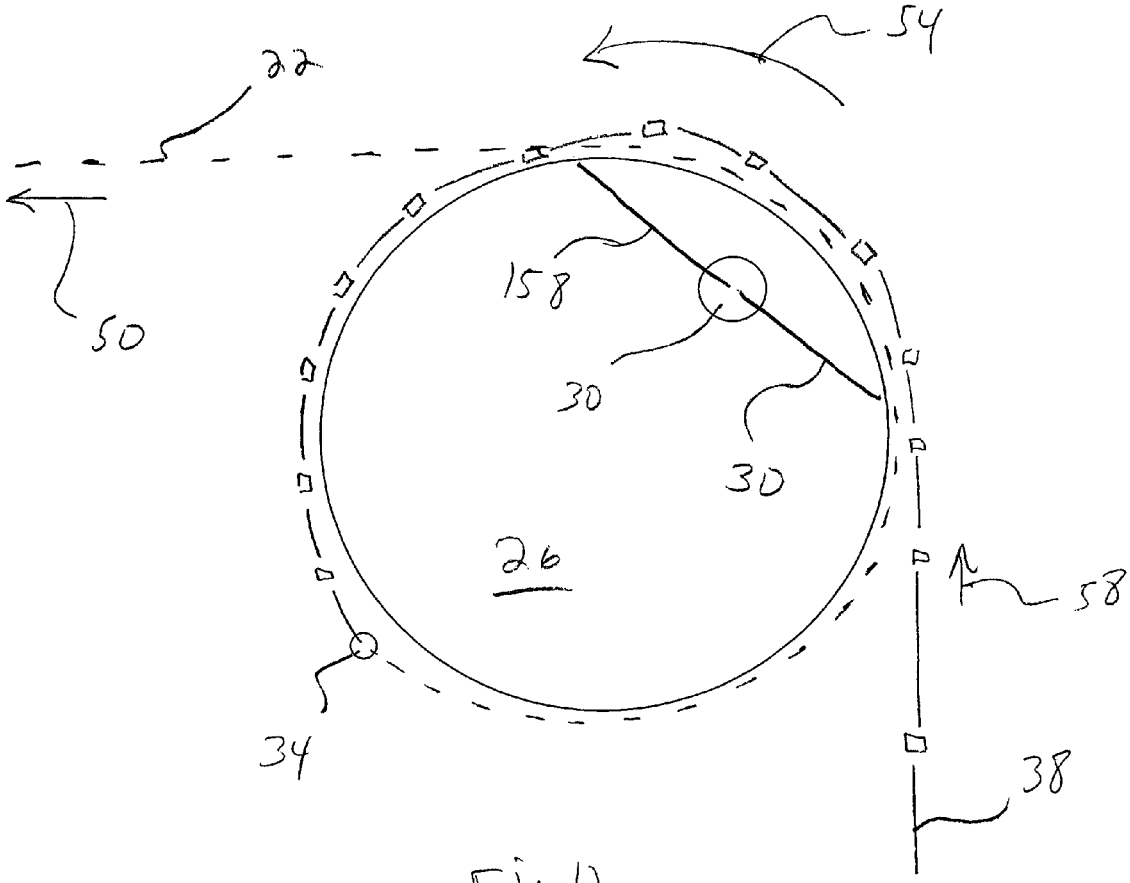
FIG. 12 is a schematic diagram illustrating the mechanical advantage delivered by the force compensating wheel after it has rotated about 45°.
Figure 13:
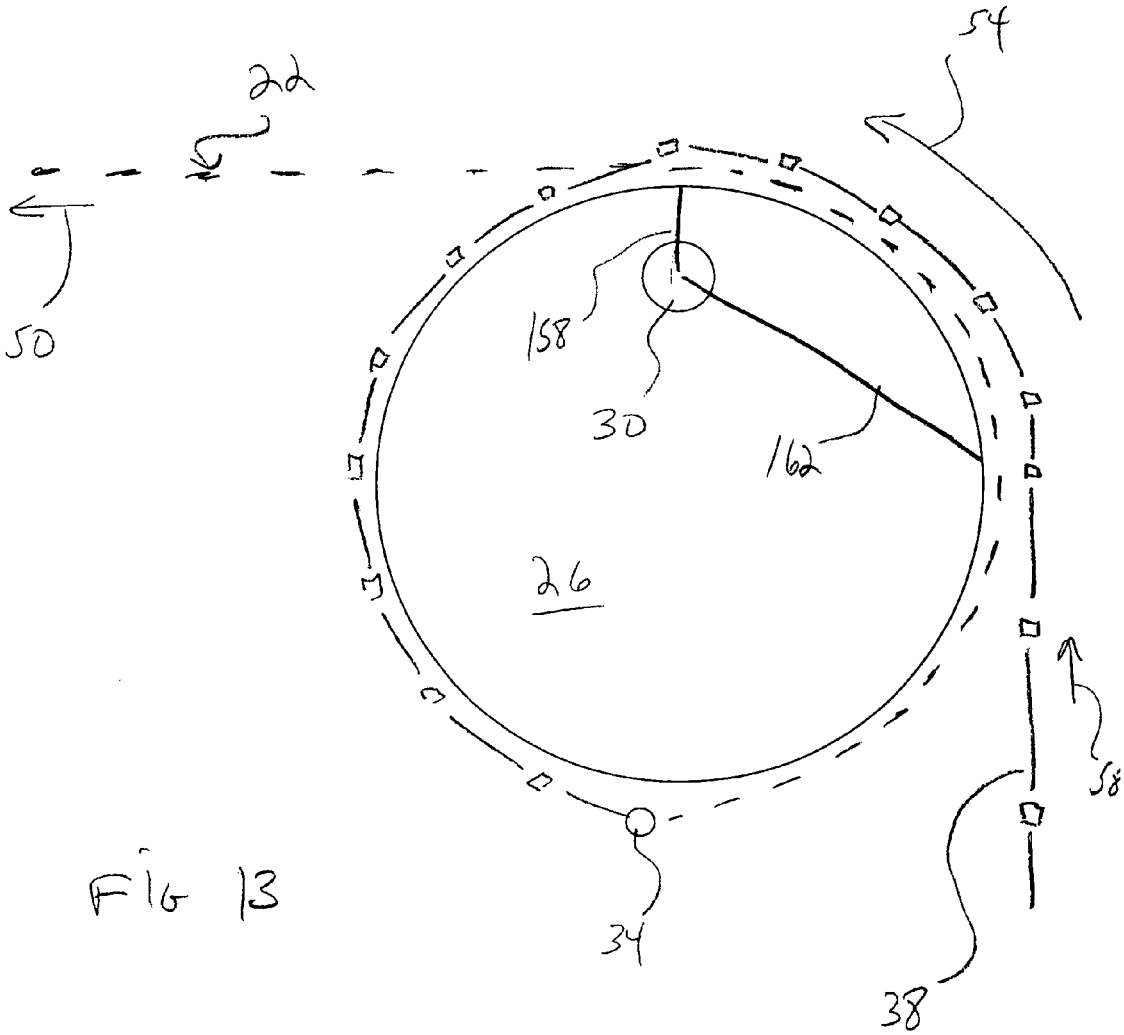
FIG. 13 is a schematic diagram illustrating the mechanical advantage delivered by the force compensating wheel after it has rotated about 90°.

FIGS. 11-13 are diagrams that illustrate the mechanical advantage delivered by the force compensating wheel 26 with the off center axle 30. FIG. 11 shows the force compensating wheel 26 just as the actuator 14 begins moving the rod 18 to the left (generally in the direction of the arrow 50). At this instant, the mechanical advantage is generally shown by the moment arms 158 and 162. Moment arm 158 is represented by the line from the center of rotation of the force compensating wheel 26 (i.e. the off center axle 30) to the tangent of the force compensating wheel 26 where the actuator chain generally leaves the force compensating wheel 26. Moment arm 162 is represented by the line from the center of rotation of the force compensating wheel 26 (i.e. the off center axle 30) to the tangent of the force compensating wheel 26 where the flush valve chain generally leaves the force compensating wheel 26. The mechanical advantage given to the actuator is shown by the relative lengths of the moment arms 158 to 162. In other words, the distance the actuator chain moves in the direction of the arrow 50 is much greater than the distance moved by the flush valve chain 38 in the direction of the arrow 58. This corresponds with systems where the initial available force of linear actuator 14 that has just started its actuation is relatively small compared to the large force required to begin lifting a actuated valve component 42 from a flush valve 46.

FIG. 12 shows the force compensating wheel 26 moved about 45° in the direction of the arrow 54. At this point, in this embodiment, the moment arms 158 and 162 are about equal in length. Thus, there is no mechanical advantage between the actuator 14 and actuated valve component 42.

FIG. 13 shows the force compensating wheel moved about 90 degrees from its position in FIG. 12. At this point, in this embodiment, the moment arm 158 is much shorter than the moment arm 62. Thus for a small distance the actuator chain 22 moves in the direction of the arrow 50, the flush valve chain 38 moves a large distance in the direction of the arrow 58. This corresponds to systems where linear actuators deliver the greatest amount of force near the end of the actuation travel, and where once the flapper is off its seat and above the strong onrush water point. less force is required to continue opening the flapper.

It should be obvious to one of ordinary skill that by varying the position of the off center axle 30, the location of the anchor 34 with respect to the axle 30, and the use of compound force compensating wheels, a person can adjust the mechanical advantage delivered by the force compensating wheel to suit many load requirements and many actuator limitations.

The disclosed variable force linear actuator system has many advantages. The disclosed variable force linear actuator allows for generally instantaneous operation. Typically devices with electric motors and gear trains are slow and cannot react fast enough to toilet overflows, especially toilets with 3 inch and larger flush valves. The disclosed system allows one to match the force available from a linear actuator to the force required for a flush valve. The system may be easily retrofitted onto existing toilet systems. The disclosed system will prevent shortened lifespans of mechanical actuators due to the actuator not being properly matched to a flush valve. The disclosed system also allows for the use of smaller less expensive actuators since the actuators are better matched with the load requirements.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An automatic flush valve comprising:

a linear actuator;

an actuator rod in operable communication with the linear actuator;

an actuator chain in communication with the actuator rod;

a wheel anchor in communication with the actuator chain;

a force compensating wheel in communication with the wheel anchor;

a flush valve chain in communication with the wheel anchor;

a actuated valve component in communication with the flush valve chain;

a flush valve in operable communication with the actuated valve component; and wherein the force compensating wheel is configured to rotate about an off center axle.

2. The automatic toilet flush valve of claim 1, wherein the force compensating wheel is configured to allow the actuator chain to move a greater distance than the flush valve chain at about the beginning of the actuator's travel, and wherein the force compensating wheel is further configured to allow the actuator chain to move generally the same distance as the flush valve chain at about the middle of the actuator's travel; and wherein the force compensating wheel is further configured to allow the actuator chain to move a smaller distance than the flush valve chain at about the end of the actuator's travel.

3. The automatic toilet flush valve of claim 1, further comprising:

raised sides located on the force compensating wheel forming a channel to hold the actuator chain and flush valve chain;

a recess located in the force compensating wheel adjacent to the anchor; and wherein the anchor is in communication with both raised sides.

4. An automatic toilet flush valve comprising:

a linear actuator;

an actuator rod in operable communication with the linear actuator;

an actuator chain in communication with the actuator rod;

a compound force compensating wheel in communication the actuator chain, the compound force compensating wheel comprising:

a first wheel;

a first wheel anchor in communication with the first wheel;

a second wheel in fixed communication with the first wheel;

a second wheel anchor in communication with the second wheel;

a flush valve chain in communication with the compound force compensating wheel;

a actuated valve component in communication with the flush valve chain;

a flush valve in operable communication with the actuated valve component; and wherein the compound force compensating wheel is configured to rotate about an off center axle.

5. The automatic toilet flush valve of claim 4, wherein:

the actuator chain is in communication with the compound force compensating wheel via the first wheel anchor; and the flush valve chain is in communication with the compound force compensating wheel via the second wheel anchor.

6. The automatic toilet flush valve of claim 4, wherein:

the actuator chain is in communication with the compound force compensating wheel via the second wheel anchor; and the flush valve chain is in communication with the compound force compensating wheel via the first wheel anchor.

7. The automatic toilet flush valve of claim 4, wherein the compound force compensating wheel is configured to allow the actuator chain to move a greater distance than the flush valve chain at about the beginning of the actuator's travel, and wherein the force compensating wheel is further configured to allow the actuator chain to move generally the same distance as the flush valve chain at about the middle of the actuator's travel; and wherein the force compensating wheel is further configured to allow the actuator chain to move a smaller distance than the flush valve chain at about the end of the actuator's travel.

8. The automatic toilet flush valve of claim 4, further comprising:

a first raised side located on the first wheel, and a second and third raised side located on the second wheel;

a recess located in the first wheel adjacent to the first wheel anchor;

a recess located in the second wheel adjacent to the second wheel anchor;

wherein the first raised side and the second raised side form a first channel on the first wheel; and wherein the second and third raised sides form a second channel on the second wheel.

9. The automatic toilet flush valve of claim 4, wherein the first wheel anchor is in communication with the first raised side and the second raised side, and wherein the second wheel anchor is in communication with the second raised side and the third raised side.

10. An electromechanical toilet flush valve actuator for use in automatic toilet flushing systems comprising:

a toilet tank;

a water-barrier container located in the toilet tank;

a linear actuator located in the water-barrier container;

an actuator rod, located in the water-barrier container, in operable communication with the linear actuator;

a shock absorber mechanism in operable communication with the actuator rod;

an actuator chain in operable communication with the shock absorber mechanism;

a flush valve actuator frame attached to the water-barrier container such that a portion of the flush valve actuator frame is located inside the water-barrier container and a portion of the flush valve actuator frame is located outside of the water-barrier container;

a first idler pulley located within the water-barrier container and rotatably coupled to the flush valve actuator frame;

a second idler pulley located outside of the water-barrier container, and rotatably coupled to the flush valve actuator frame;

a force compensating wheel located outside of the water-barrier container, and rotatably coupled to the flush valve actuator frame via an off center axle rotatably coupled to the flush valve actuator frame;

a wheel anchor in communication with force compensating wheel;

a flush valve located in the toilet tank;

an actuated valve component in operable communication with the flush valve;

a flush valve chain in communication with the actuated valve component; and wherein the wheel anchor is in communication with the actuator chain and with the flush valve chain.

11. The automatic toilet flushing system of claim 10, wherein the shock absorber mechanism comprises:

an actuator rod pulley located on an end of the actuator rod;

a shock absorber anchor in fixed communication with the flush valve actuator frame;

a shock absorber in communication with the shock absorber anchor and the actuator chain; and wherein the actuator chain is configured to ride upon the actuator rod pulley.

12. The automatic toilet flushing system of claim 10, wherein the force compensating wheel is configured to allow the actuator chain to move a greater distance than the flush valve chain at about the beginning of the actuator's travel, and wherein the force compensating wheel is further configured to allow the actuator chain to move generally the same distance as the flush valve chain at about the middle of the actuator's travel; and wherein the force compensating wheel is further configured to allow the actuator chain to move a smaller distance than the flush valve chain at about the end of the actuator's travel.

13. The automatic toilet flushing system of claim 10, further comprising:

raised sides located on the force compensating wheel forming a channel to hold the actuator chain and flush valve chain; and a recess located in the force compensating wheel adjacent to the anchor.

* * * * *